US008413808B1

(12) United States Patent
Tong

(10) Patent No.: US 8,413,808 B1
(45) Date of Patent: Apr. 9, 2013

(54) RECEIVING SPACER LAYER FOR MOBILE ELECTRONIC DEVICE AND BAG COMBINED WITH THE RECEIVING SPACER LAYER

(76) Inventor: Joy Tong, Boca Raton, FL (US)

( * ) Notice: Subject to any disclaimer, the term of this patent is extended or adjusted under 35 U.S.C. 154(b) by 0 days.

(21) Appl. No.: 13/268,116

(22) Filed: Oct. 7, 2011

(51) Int. Cl.
*B65D 85/00* (2006.01)
*B65D 81/02* (2006.01)

(52) U.S. Cl. ..... 206/320; 206/305; 206/523; 206/588; 206/592

(58) Field of Classification Search ..... 206/305, 206/320, 521, 523, 588, 592; 190/102, 103, 190/109, 110, 112, 115, 117, 119, 121
See application file for complete search history.

(56) References Cited

U.S. PATENT DOCUMENTS

| | | | | | |
|---|---|---|---|---|---|
| 3,768,724 | A * | 10/1973 | Hill | 206/523 |
| 5,010,988 | A * | 4/1991 | Brown | 190/104 |
| 5,494,157 | A * | 2/1996 | Golenz et al. | 206/320 |
| 5,775,497 | A * | 7/1998 | Krulik | 206/320 |
| 5,960,952 | A * | 10/1999 | Chen | 206/320 |
| 6,213,266 | B1 * | 4/2001 | Hollingsworth | 190/108 |
| 6,237,766 | B1 * | 5/2001 | Hollingsworth | 206/320 |
| 6,827,185 | B2 * | 12/2004 | Scicluna | 190/110 |
| 7,793,782 | B2 * | 9/2010 | Chuang | 206/320 |
| 2002/0108886 | A1 * | 8/2002 | Kim | 206/523 |
| 2005/0189188 | A1 * | 9/2005 | Barnes | 190/110 |
| 2007/0199855 | A1 * | 8/2007 | Lim | 206/523 |
| 2010/0089778 | A1 * | 4/2010 | Park | 206/320 |

* cited by examiner

*Primary Examiner* — Bryon Gehman
(74) *Attorney, Agent, or Firm* — Pai Patent & Trademark Law Firm; Chao-Chang David Pai

(57) ABSTRACT

The present invention relates to a receiving spacer layer for a mobile electronic device and a bag combined with the receiving spaced layer. The receiving spacer layer includes a protection pad which is made of a soft foam material and has a first accommodation space to receive a first electronic device, and a bag fabric is connected to the first accommodation space to receive the first electronic device. The receiving spacer layer is combined with the inside of the bag. The bag has a second accommodation space to receive a second electronic device, such as a notebook computer. The first and accommodation spaces are able to accommodate two mobile electronic devices. The present invention is convenient for use and can be carried with ease.

12 Claims, 7 Drawing Sheets

RECEIVING SPACER LAYER FOR MOBILE ELECTRONIC DEVICE AND BAG COMBINED WITH THE RECEIVING SPACER LAYER

BACKGROUND OF THE INVENTION (a) Field of the Invention

The present invention relates to a receiving spacer layer for a mobile electronic device, and more particular to a receiving spacer layer coupled to the inside of a backpack, a side bag or a travelling bag, and a bag combined with the receiving spacer layer.

(b) Description of the Prior Art

Nowadays, people have several electronic devices for different demands. For example, a notebook is used for an operation system, and a tablet computer (iPad) is used for watching a movie, surfing on the internet or playing the Facebook. A smart mobile phone can be used to make a phone call or have a video conference or play the Facebook. Thereby, it is very common for a user to own a notebook computer and a tablet computer. So far, conventional bags, such as backpacks, side bags or travelling bags, on the market don't have the function to carry both the notebook computer and the tablet computer. The user puts the notebook computer and the tablet computer into his/her bag, without any protection to the notebook computer and the tablet computer. When passing the customs, the user has to take out the notebook computer and the tablet computer one by one from his/her bag for examination. This is very inconvenient for use. Accordingly, the inventor of the present invention has devoted himself based on his many years of practical experiences to solve these problems.

SUMMARY OF THE INVENTION

The primary object of the present invention is to provide a receiving spacer layer for a mobile electronic device. The receiving spacer layer is coupled to the inside of a backpack, a side bag or a travelling bag to receive and protect a tablet computer, which is convenient for use.

A further object of the present invention is to provide a bag combined with the receiving spacer layer. The receiving spacer layer is coupled to the inside of the bag, so that the bag has two accommodation spaces to receive and protect two electronic devices, such as a tablet computer and a notebook computer.

DETAILED DESCRIPTION OF THE PREFERRED EMBODIMENTS

Embodiments of the present invention will now be described, by way of example only, with reference to the accompanying drawings.

Figure 1:
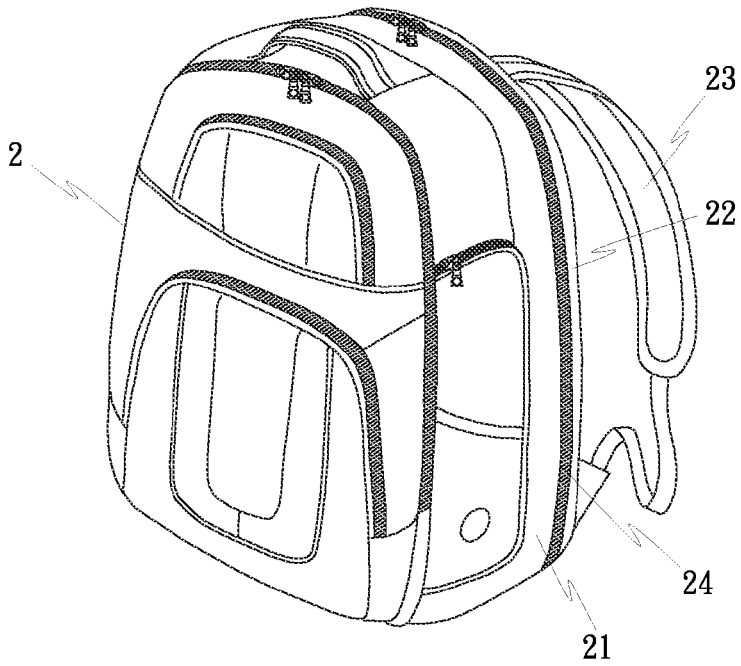
FIG. 1 is a perspective view showing the bag combined with the receiving spacer layer according to a preferred embodiment of the present invention.
Figure 2:
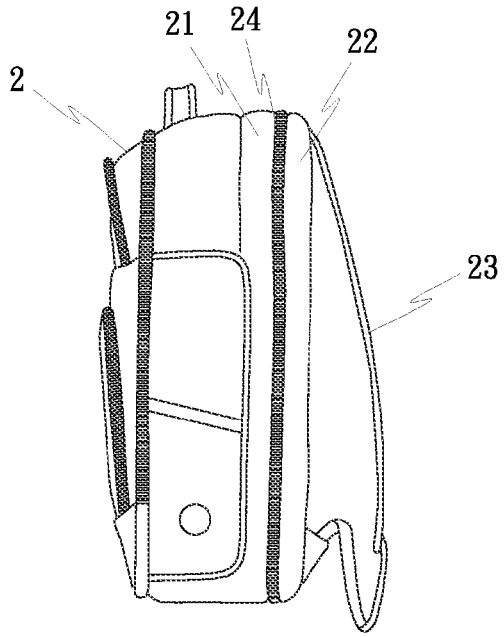
FIG. 2 is a side view showing the bag combined with the receiving spacer layer according to the preferred embodiment of the present invention.
Figure 3:
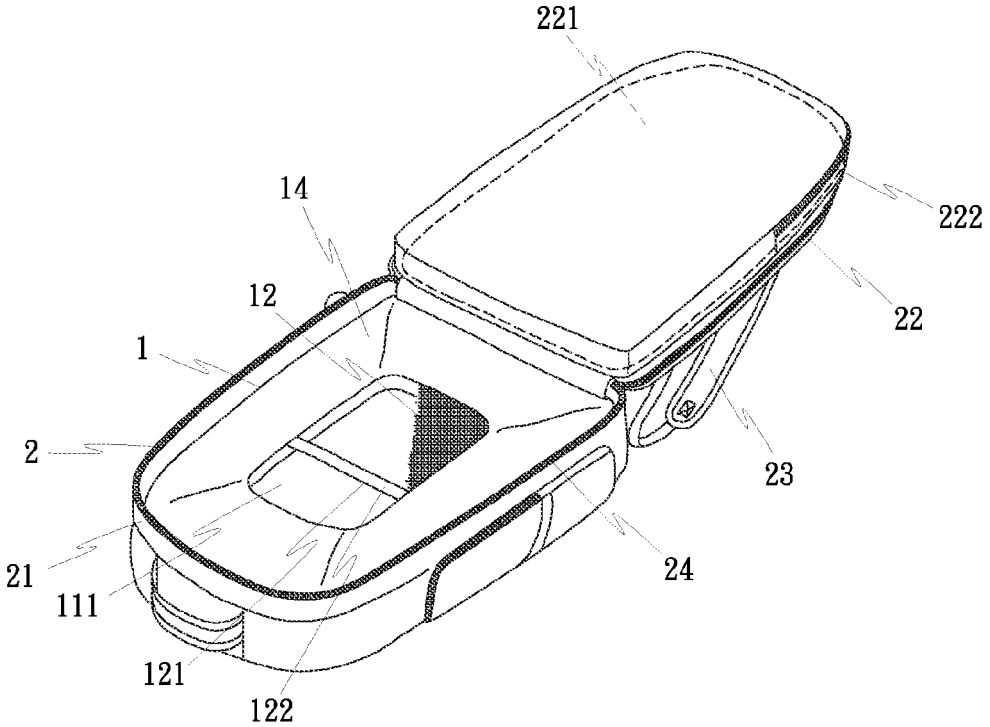
FIG. 3 is a perspective view showing the bag combined with the receiving spacer layer according to the preferred embodiment of the present invention in an open state.
Figure 4:
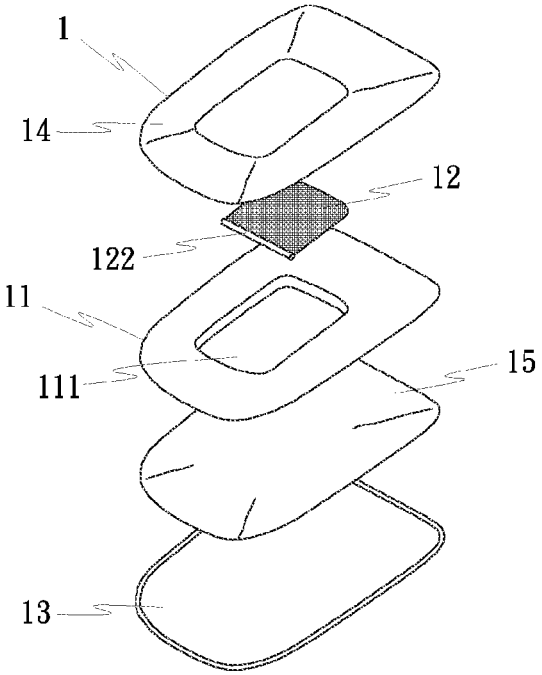
FIG. 4 is an exploded view showing the receiving spacer layer according to the preferred embodiment of the present invention.
Figure 7:
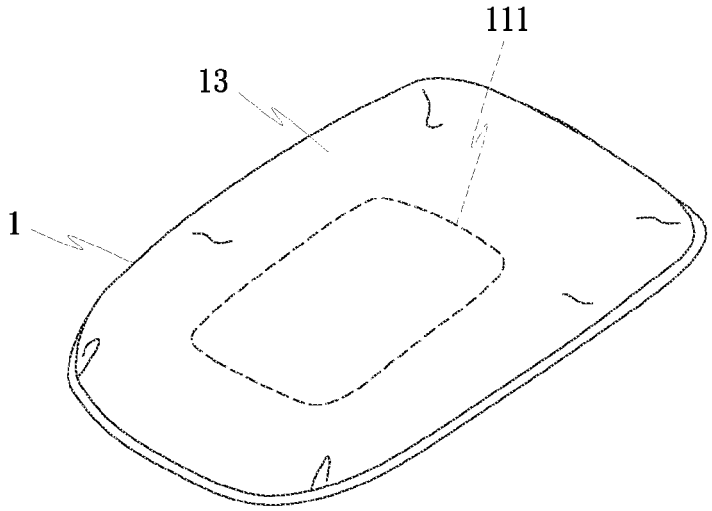
FIG. 7 is a rear view showing the receiving spacer layer according to the preferred embodiment of the present invention.

As shown in FIG. 1 through FIG. 3, the receiving spacer layer 1 for a mobile electronic device according to a preferred embodiment of the present invention is coupled to an inside of a bag 2 to receive and protect a first electronic device, in particular, to receive a tablet computer (for example, an IPad.) Referring to FIG. 4 and FIG. 7, the receiving spacer layer 1 comprises a first protection pad 11, a bag fabric 12, and a back fabric 13. The first protection pad 11 is made of a soft foam material. The first protection pad 11 has a front side formed with a first accommodation space 111 to receive the first electronic device. The first accommodation space 111 corresponds in size to the first electronic device, such as a 10-inch tablet computer (iPad). The bag fabric 12 is a soft fabric connected to the first accommodation space 111. The bag fabric 12 has three sides connected with the periphery of the first accommodation space 111 and a free side which is not connected with the first accommodation space 111 to form an entry 121, so that the first electronic device can be inserted in the first accommodation space 111. The back fabric 13 is a soft fabric corresponding in shape to the first protection pad 11, and connected to a rear side of the first protection pad 11. Thereby, the receiving spacer layer 1 for a mobile electronic device is completed.

Figure 5:
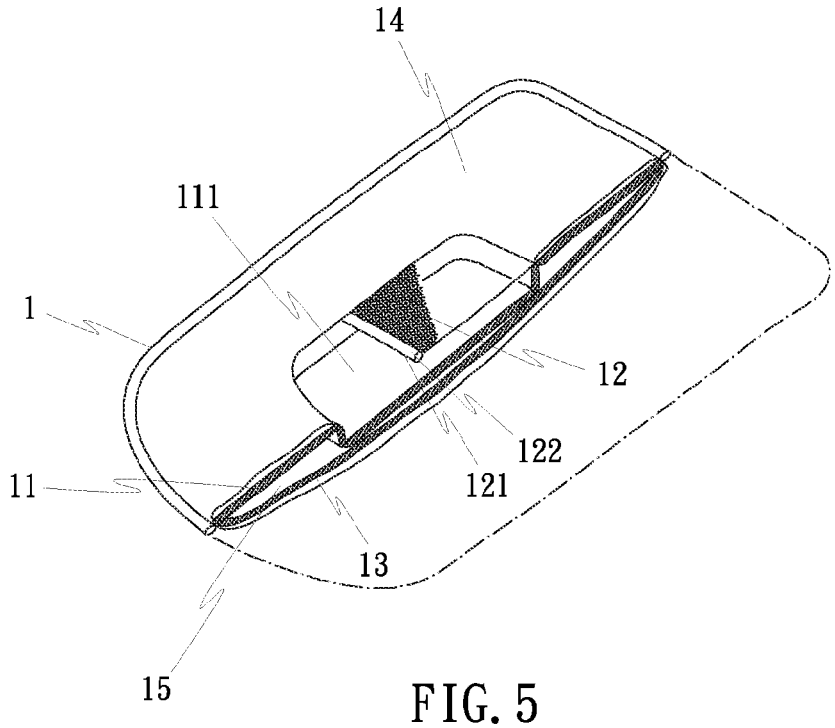
FIG. 5 is a sectional view showing the receiving spacer layer according to the preferred embodiment of the present invention.
Figure 6:
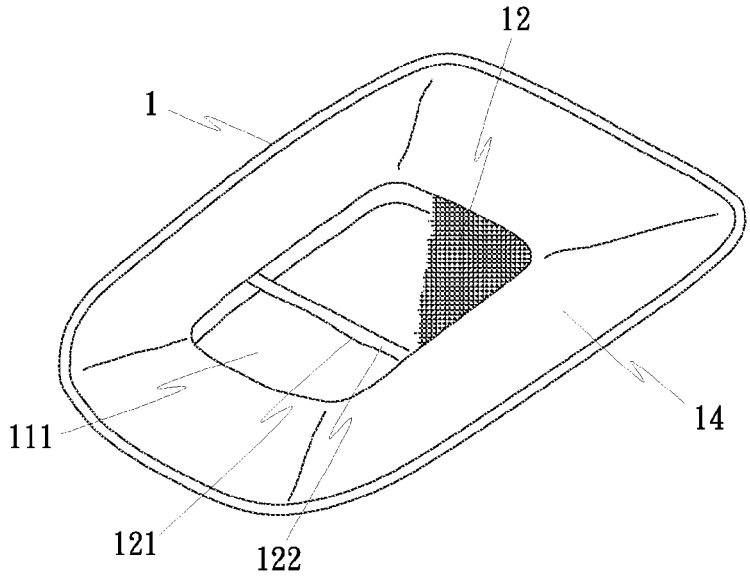
FIG. 6 is a front view showing the receiving spacer layer according to the preferred embodiment of the present invention.

Referring to FIG. 4, FIG. 5, and FIG. 6, the receiving spacer layer 1 further comprises a face fabric 14 which is connected to the front side of the first protection pad 11 but does not cover the first accommodation space 111 for protection of the first protection pad 11 which is made of the soft foam material and for beautiful appearance. Referring to FIG. 4, FIG. 5, and FIG. 7, the receiving spacer layer 1 further comprises a second protection pad 15 which corresponds in shape to the first protection pad 11 and is disposed between the first protection pad 11 and the back fabric 13 for protection of the first electronic device. Referring to FIG. 4 and FIG. 6, the bag fabric 12 is an elastic meshed fabric and has an expansible band 122 disposed at the free end which is not connected with the first accommodation space 111 so as to take the first electronic device with ease.

Referring to FIG. 1 through FIG. 3, the bag 2 combined with the receiving spacer layer 1 of the present invention can be used to carry two mobile electronic devices, such as a tablet computer and a notebook computer. The bag 2 has a first bag body 21, a second bag body 22 connected to the first bag body 21, and a carrying member 23 (such as a strap, a belt or a pull rod) connected to second bag body 22. The first bag body 21 is made of a soft fabric to form a hollow body as the front of the bag 2. The second bag body 22 corresponds in shape to the first bag body 21. The second bag body 22 has a second accommodation space 221 to receive a second electronic device. The second bag body 22 has a bottom side connected to a bottom side of the first bag body 21, such that the second bag body 22 and the first bag body 21 can be opened and closed. Respective edges of the second bag body 22 and the first bag body 21 have a zipper 24 to connect with each other. The receiving spacer layer 1 is connected (sewn) to an inner side wall of the first bag body 21, so that the receiving spacer layer 1 is adjacent to the second bag body 22.

Figure 8:
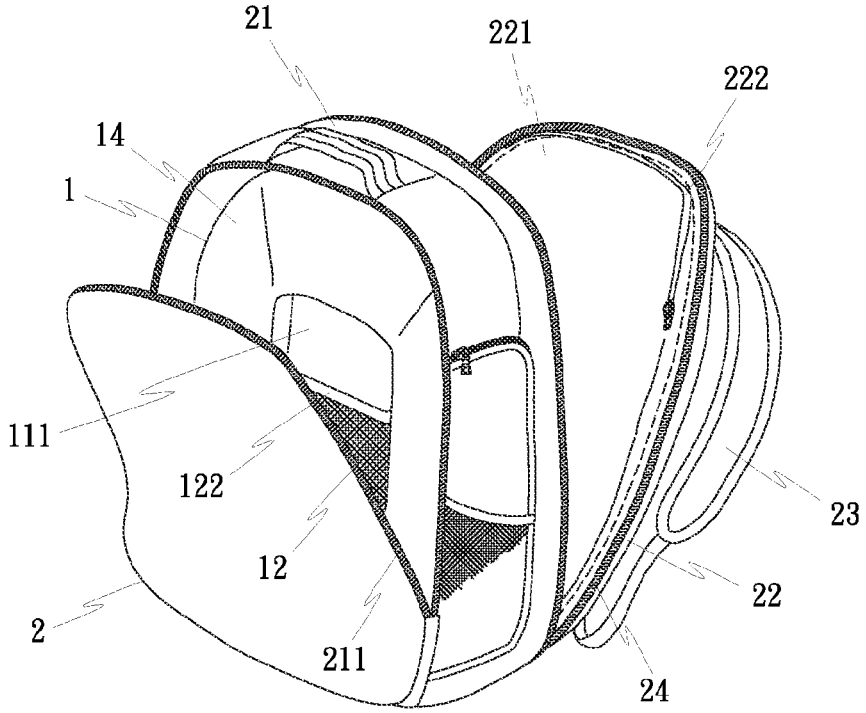
FIG. 8 is a perspective view showing the bag combined with the receiving spacer layer according to a second embodiment of the present invention.

Referring to FIG. 3, when the receiving spacer layer 1 is connected (sewn) to the inner side wall of the first bag body 21, the first accommodation space 111 faces the second bag body 22 and the zipper 24 is open to show the first accommodation space 111. Referring to FIG. 8, the first accommodation space 111 is back-to-back relative to the second bag body 22 and a zipper 211 of the first bag body 21 is open to show the first accommodation space 111.

Figure 9:
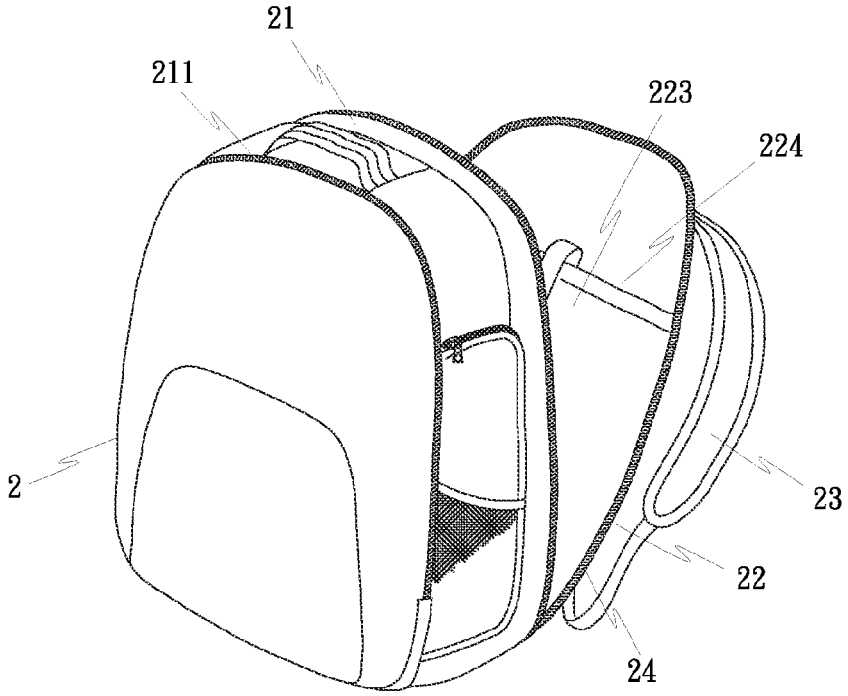
FIG. 9 is a perspective view showing the bag combined with the receiving spacer layer according to a third embodiment of the present invention.

Referring to FIG. 3 and FIG. 8, the second bag body 22 has the second accommodation space 221 to receive the second electronic device and a zipper opening 222 at the edge of the second bag body 22, so that the user can put the notebook computer in the second accommodation space 221. As shown in FIG. 9, the second bag body 22 further comprises a bag fabric 223 at an inner side thereof adjacent to the first bag body 21. The second accommodation space 221 is formed between the bag fabric 223 and the second bag body 22, and an entry 224 of the second accommodation space 221 is defined at an upper end of the bag fabric 223, so that the user can put the second electronic device into the second accommodation space 221 from the entry 224.

Figure 10:
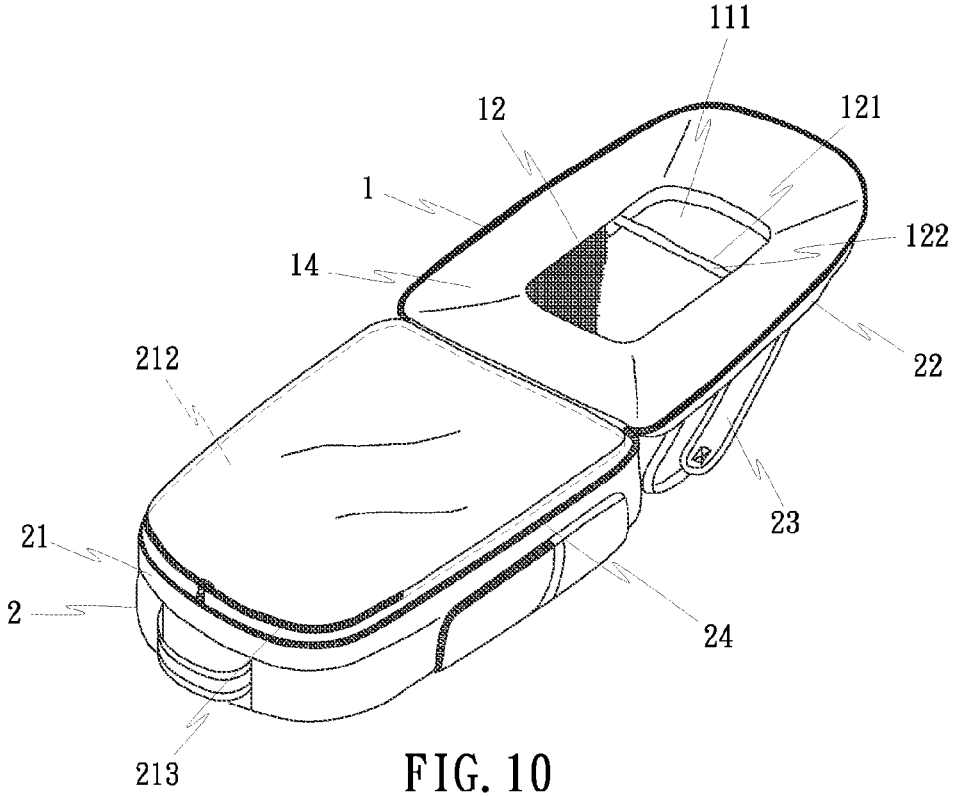
FIG. 10 is a perspective view showing the bag combined with the receiving spacer layer according to a fifth embodiment of the present invention.

As shown in FIG. 10, the configurations of the first bag body 21 and the second bag body 22 are exchangeable. The first bag body 21 is made of a soft fabric to form a hollow body. The first bag body 21 has a second accommodation space 212 to receive a second electronic device. The second bag body 22 corresponds in shape to the first bag body 21. The second bag body 22 has a bottom side connected to a bottom side of the first bag body 21, such that the second bag body 22 and the first bag body 21 can be opened and closed. Respective edges of the second bag body 22 and the first bag body 21 have a zipper 24 to connect with each other. The receiving spacer layer 1 is connected (sewn) to an inner side wall of the second bag body 22, so that the receiving spacer layer 1 is adjacent to the first bag body 21 and the first accommodation space 111 faces the first bag body 21.

Figure 11:
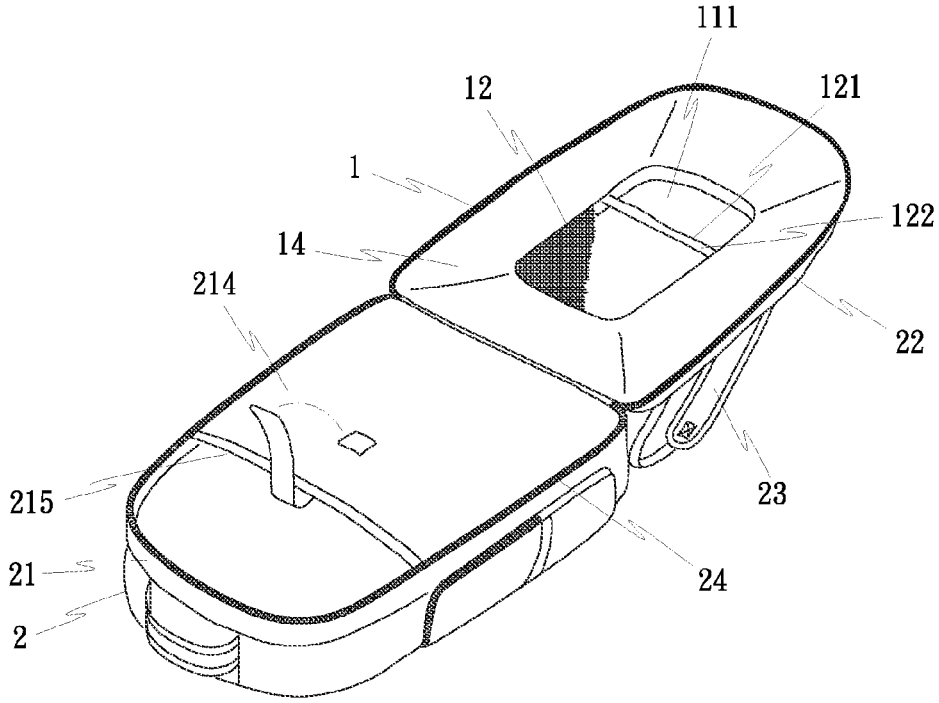
FIG. 11 is a perspective view showing the bag combined with the receiving spacer layer according to a fifth embodiment of the present invention.
Figure 12:
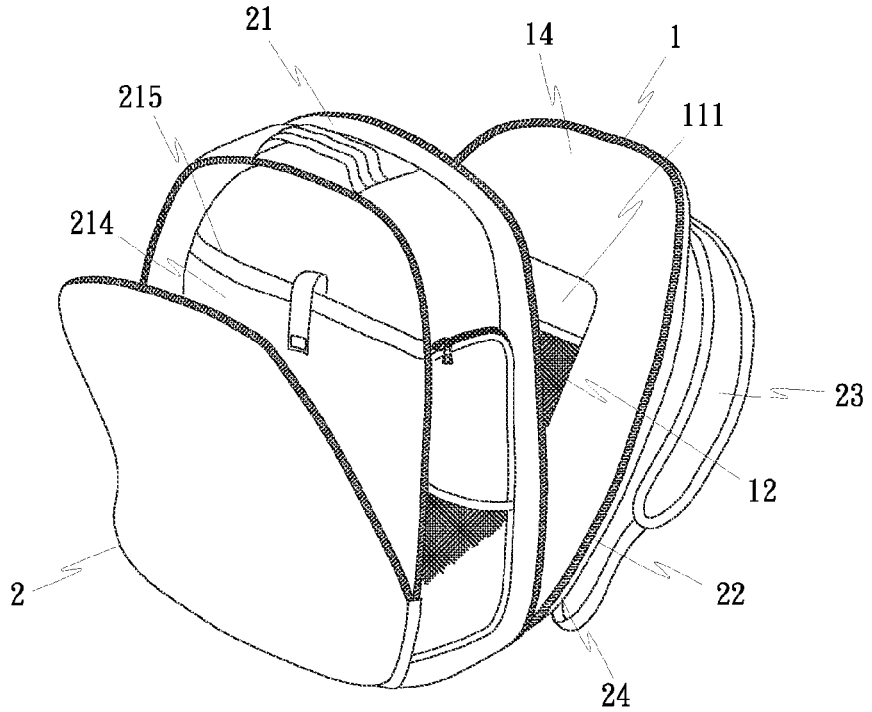
FIG. 12 is a perspective view showing the bag combined with the receiving spacer layer according to a sixth embodiment of the present invention.

Referring to FIG. 10, the first bag body 21 has the second accommodation space 212 to receive the second electronic device and a zipper opening 213 at the edge of the first bag body 21, so that the user can put the notebook computer in the second accommodation space 212. As shown in FIG. 11 or FIG. 12, the first bag body 21 further comprises a bag fabric 214 at an inner side thereof adjacent to the second bag body 22 or at the back of the second bag body 22. The second accommodation space 212 is formed between the bag fabric 214 and the first bag body 21, and an entry 215 of the second accommodation space 212 is defined at an upper end of the bag fabric 214, so that the user can put the second electronic device into the second accommodation space 212 from the entry 215.

Through the receiving spacer layer 1, the user can put the tablet computer (iPad) into the first accommodation space 111 and the tablet computer is protected by the first protection pad 11 and the second protection pad 15. Through the configuration of the first accommodation space 111 and the bag fabric 12, the tablet computer can be taken out easily. By using the receiving spacer layer 1 combined with the bag 2, the first bag body 21, the second bag body 22, and the zipper 24, the bag 2 has the first accommodation space 111 and the second accommodation space 221 to receive the tablet computer (iPad) and the notebook computer, respectively. When the user wants to take out the electronic devices or passes the customs, the zipper 24 can be opened to show the first bag body 21 and the second bag body 22. The present invention is very convenient for use.

Figure 13:
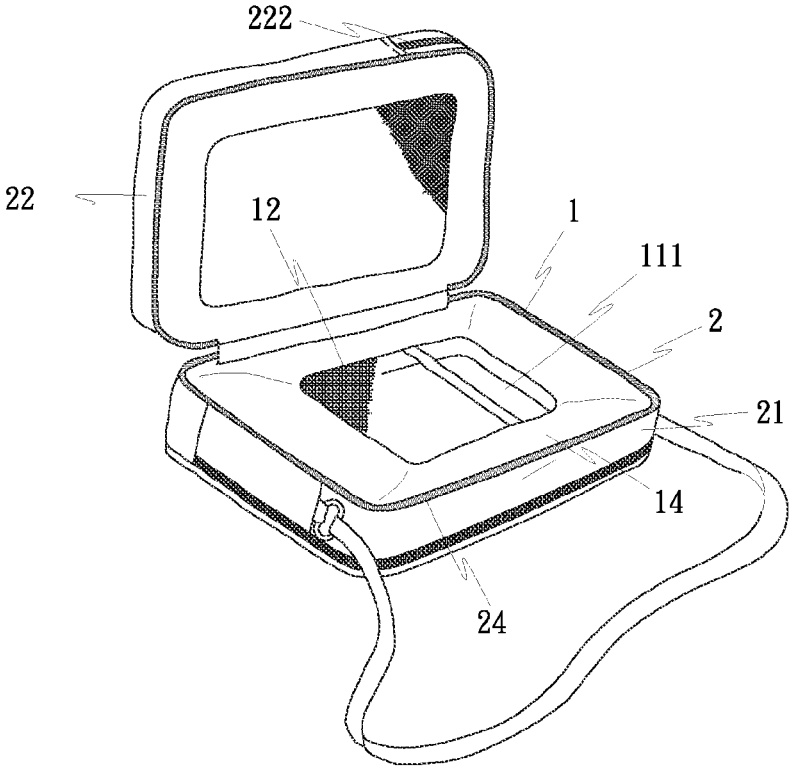
FIG. 13 is a perspective view showing the bag combined with the receiving spacer layer according to a seventh embodiment of the present invention.
Figure 14:
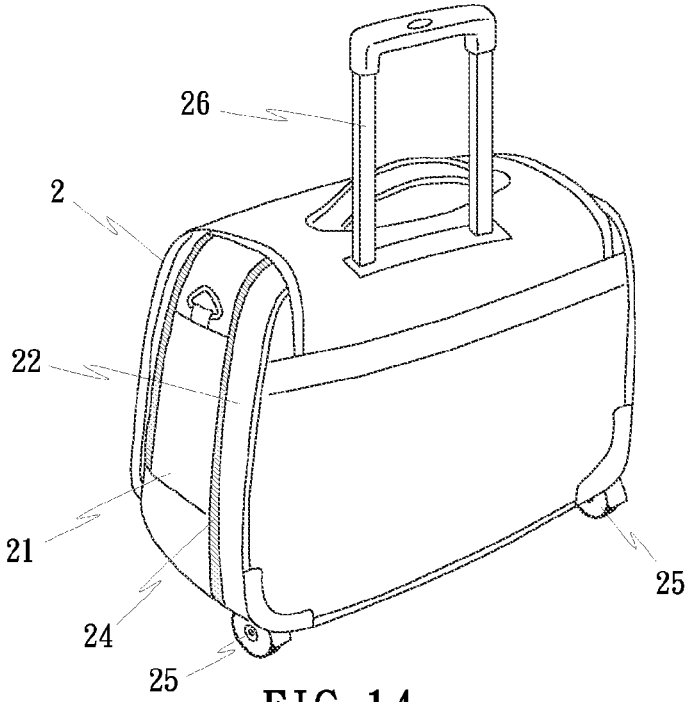
FIG. 14 is a perspective view showing the bag combined with the receiving spacer layer according to an eighth preferred embodiment of the present invention.

It is noted that the bag 2 of the present invention can be a backpack as shown in FIG. 1, or a side bag as shown in FIG. 13, or a traveling bag or a duffel bag with rollers 25 and a pull rod 26. The backpack, side bag, traveling bag or duffel bag comprises the receiving spacer layer 1, the first accommodation space 111, and the second accommodation space 221, 212 to receive two electronic devices, such as a notebook computer and a tablet computer (iPad), having the same effect as the aforesaid.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A receiving spacer layer for a mobile electronic device, the receiving spacer layer for coupling to an inside of a bag for receiving a first electronic device, the receiving spacer layer comprising a face fabric, a first protection pad, a bag fabric and a back fabric, wherein:

the first protection pad is made of a soft foam material and has a front side formed with a first accommodation space for receiving the first electronic device;

the bag fabric is an elastic meshed fabric having three sides connected with a periphery of the first accommodation space and a free side which is not connected with the periphery of the first accommodation space to form an entry to the first accommodation space, wherein an expansible band is disposed at the free side; the face fabric is connected to the front side of the first protection pad without covering the first accommodation space; and the back fabric is connected to a rear side of the first protection pad.

2. The receiving spacer layer for a mobile electronic device as claimed in claim 1, further comprising a second protection pad disposed between the first protection pad and the back fabric.

3. A bag comprising a first bag body, a second bag body connected to the first bag body, a receiving spacer layer for receiving a first electronic device, and a carrying member connected to the second bag body, the first bag body being made of a soft fabric to form a hollow body, the second bag body corresponding in shape to the first bag body, the second bag body having a second accommodation space for receiving a second electronic device, the second bag body having a bottom side connected to a bottom side of the first bag body so that the second bag body and the first bag body are able to be opened and closed, respective edges of the second bag body and the first bag body having a zipper to connect with each other, the receiving spacer layer being connected to an inner side wall of the first bag body, the receiving spacer layer being adjacent to the second bag body and comprising a face fabric, a first protection pad, a bag fabric and a back fabric, wherein:

the first protection pad is made of a soft foam material and has a front side formed with a first accommodation space for receiving the first electronic device;

the bag fabric is an elastic meshed fabric having three sides connected with a periphery of the first accommodation space and a free side which is not connected with the periphery of the first accommodation space to form an entry to the first accommodation space, wherein an expansible band is disposed at the free side;

the face fabric is connected to the front side of the first protection pad without covering the first accommodation space; and the back fabric is connected to a rear side of the first protection pad.

4. The bag as claimed in claim 3, wherein the first accommodation space of the receiving spacer layer faces the second bag body.

5. The bag as claimed in claim 3, wherein the first accommodation space of the receiving spacer layer and the second bag body are back-to-back.

6. The bag as claimed in claim 3, wherein the second bag body has a zipper opening at an edge of the second bag body.

7. The bag as claimed in claim 3, wherein the second bag body further comprises a bag fabric at an inner side thereof adjacent to the first bag body, the second accommodation space being formed between the bag fabric and the second bag body, an entry of the second accommodation space being formed at an upper end of the bag fabric.

8. The bag as claimed in claim 3, wherein the receiving spacer layer further comprises a second protection pad disposed between the first protection pad and the back fabric.

9. A bag comprising a first bag body, a second bag body connected to the first bag body, a receiving spacer layer for receiving a first electronic device, and a carrying member connected to the second bag body, the first bag body being made of a soft fabric to form a hollow body, the first bag body having a second accommodation space for receiving a second electronic device, the second bag body corresponding in shape to the first bag body, the second bag body having a bottom side connected to a bottom side of the first bag body so that the second bag body and the first bag body are able to be opened and closed, respective edges of the second bag body and the first bag body having a zipper to connect with each other, the receiving spacer layer being connected to an inner side wall of the second bag body, the receiving spacer layer being adjacent to the first bag body and comprising a face fabric, a first protection pad, a bag fabric and a back fabric, wherein:

the first protection pad is made of a soft foam material and has a front side formed with a first accommodation space for receiving the first electronic device;

the bag fabric is an elastic meshed fabric having three sides connected with a periphery of the first accommodation space and a free side which is not connected with the periphery of the first accommodation space to form an entry to the first accommodation space, wherein an expansible band is disposed at the free side;

the face fabric is connected to the front side of the first protection pad without covering the first accommodation space; and the back fabric is connected to a rear side of the first protection pad.

10. The bag as claimed in claim 9, wherein the first bag body has a zipper opening at an edge of the first bag body.

11. The bag as claimed in claim 9, wherein the first bag body further comprises a bag fabric at an inner side thereof, the second accommodation space being formed between the bag fabric and the first bag body, an entry of the second accommodation space being formed at an upper end of the bag fabric.

12. The bag as claimed in claim 9, wherein the receiving spacer layer further comprises a second protection pad disposed between the first protection pad and the back fabric.

* * * * *